US010636341B2

(12) United States Patent
Tung et al.

(10) Patent No.: US 10,636,341 B2
(45) Date of Patent: Apr. 28, 2020

(54) METHOD OF PROCESSING IMAGE DATA AND RELATED IMAGE PROCESSING DEVICE

(71) Applicant: NOVATEK Microelectronics Corp., Hsin-Chu (TW)

(72) Inventors: Chia-Hsin Tung, Hsinchu (TW); Yung-Chien Fan, Hsinchu County (TW); Wen-Kai Hsieh, Hsinchu County (TW); Shu-Yuan Hsu, Hsinchu County (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 23 days.

(21) Appl. No.: 16/153,849

(22) Filed: Oct. 8, 2018

(65) Prior Publication Data

US 2020/0082745 A1 Mar. 12, 2020

Related U.S. Application Data

(60) Provisional application No. 62/728,881, filed on Sep. 10, 2018.

(51) Int. Cl.
*G09G 3/20* (2006.01)

(52) U.S. Cl.
CPC ..... *G09G 3/20* (2013.01); *G09G 2330/023* (2013.01); *G09G 2340/02* (2013.01); *G09G 2340/0457* (2013.01); *G09G 2360/18* (2013.01)

(58) Field of Classification Search
CPC ..... G09G 3/20; G09G 2230/023; G09G 2240/02; G09G 2240/0457; G09G 2630/18; G09G 2320/046; G09G 2330/022; G09G 5/373; G09G 5/399; G06F 1/3287; G06T 1/60
See application file for complete search history.

(56) References Cited

U.S. PATENT DOCUMENTS

2007/0285428 A1* 12/2007 Foster ..... G06F 3/14 345/503
2014/0281607 A1* 9/2014 Tse ..... G06F 1/3287 713/320
2016/0133231 A1* 5/2016 Liu ..... G09G 5/14 345/205
2017/0116927 A1* 4/2017 Bae ..... G06T 11/60
2018/0204303 A1* 7/2018 Bae ..... G09G 5/363
2018/0314315 A1* 11/2018 Chang ..... G09G 3/36

* cited by examiner

*Primary Examiner* — Kenneth Bukowski
(74) *Attorney, Agent, or Firm* — Winston Hsu

(57) ABSTRACT

A method of processing an image data for an image processing device includes a plurality of steps. The steps include receiving the image data; storing the image data in a frame buffer of the image processing device; performing a signal processing procedure on the image data obtained from the frame buffer, to generate a final display data; restoring the final display data in the frame buffer; and entering a power saving mode after the final display data is restored in the frame buffer. In the power saving mode, the image processing device performs the following steps: turning off the signal processing circuit; and outputting the final display data restored in the frame buffer, to display the final display data.

8 Claims, 6 Drawing Sheets

METHOD OF PROCESSING IMAGE DATA AND RELATED IMAGE PROCESSING DEVICE

CROSS REFERENCE TO RELATED APPLICATIONS

This application claims the benefit of U.S. Provisional Application No. 62/728,881, filed on Sep. 10, 2018, the contents of which are incorporated herein by reference.

BACKGROUND OF THE INVENTION

1. Field of the Invention

The present invention relates to image data processing, and more particularly, to a method of processing image data capable of achieving power saving effects.

2. Description of the Prior Art

An organic light-emitting diode (OLED) is a light-emitting diode (LED) in which the emissive electroluminescent layer is a film of organic compound, where the organic compound can emit light in response to an electric current. OLEDs are widely used in displays of electronic devices such as television screens, computer monitors, portable systems such as mobile phones, handheld game consoles and personal digital assistants (PDAs). The display operation of a general OLED display, as different from a liquid crystal display (LCD), is not enabled by a backlight source; hence, an electronic device using the OLED display usually operates in an always on display (AOD) mode, to keep showing necessary information such as date, time, and/or power quantity in a small area during an idle time.

The image data may undergo some image processing procedures before being displayed on an OLED panel. For example, a general OLED display may have a lower pixel per inch (ppi), so a data processing technique such as the subpixel rendering (SPR) technique is applied to enhance the visual resolution. In order to improve the uniformity of an OLED display image, a demura compensation technique is applied to process the image data. For a full-color image or complex image having a great amount of image data, data compression and decompression are required, allowing the great amount of image data to be stored in a limited frame buffer after being compressed. The abovementioned image processing operations result in large power consumption.

In the AOD mode, power consumption is an important issue to be considered because there is only a little necessary information displayed in a small area of the panel. In order to reduce power consumption, a conventional method may, for example, generate an image having lower quality with an inferior SPR algorithm. Alternatively, the demura operation may be omitted for image data with a lower brightness, or an image with reduced color format is applied so as to reduce the amount of image data such that a simplified data compression technique is feasible. All of these methods have a tradeoff that the image quality may be reduced in order to achieve less power consumption.

Thus, there is a need to provide a novel image processing method to improve the power consumption problem and also remain the image quality for an AOD image.

SUMMARY OF THE INVENTION

It is therefore an objective of the present invention to provide a method of processing image data and a related image processing device which are capable of achieving the purpose of power saving without reducing the quality of displayed image.

An embodiment of the present invention discloses a method of processing an image data for an image processing device. The method comprises receiving the image data; storing the image data in a frame buffer of the image processing device; performing a signal processing procedure on the image data obtained from the frame buffer, to generate a final display data; restoring the final display data in the frame buffer; and entering a power saving mode after the final display data is restored in the frame buffer. In the power saving mode, the image processing device performs the following steps: turning off the signal processing circuit; and outputting the final display data restored in the frame buffer, to display the final display data.

Another embodiment of the present invention discloses an image processing device, which comprises a receiver, a frame buffer, a signal processing circuit and a source driver. The receiver is configured to receive an image data. The frame buffer is configured to store the image data. The signal processing circuit is configured to perform a signal processing procedure on the image data obtained from the frame buffer to generate a final display data, and transmit the final display data to the frame buffer to restore the final display data in the frame buffer. The source driver is configured to output the final display data restored in the frame buffer, to display the final display data in a power saving mode. The signal processing circuit is turned off in the power saving mode.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
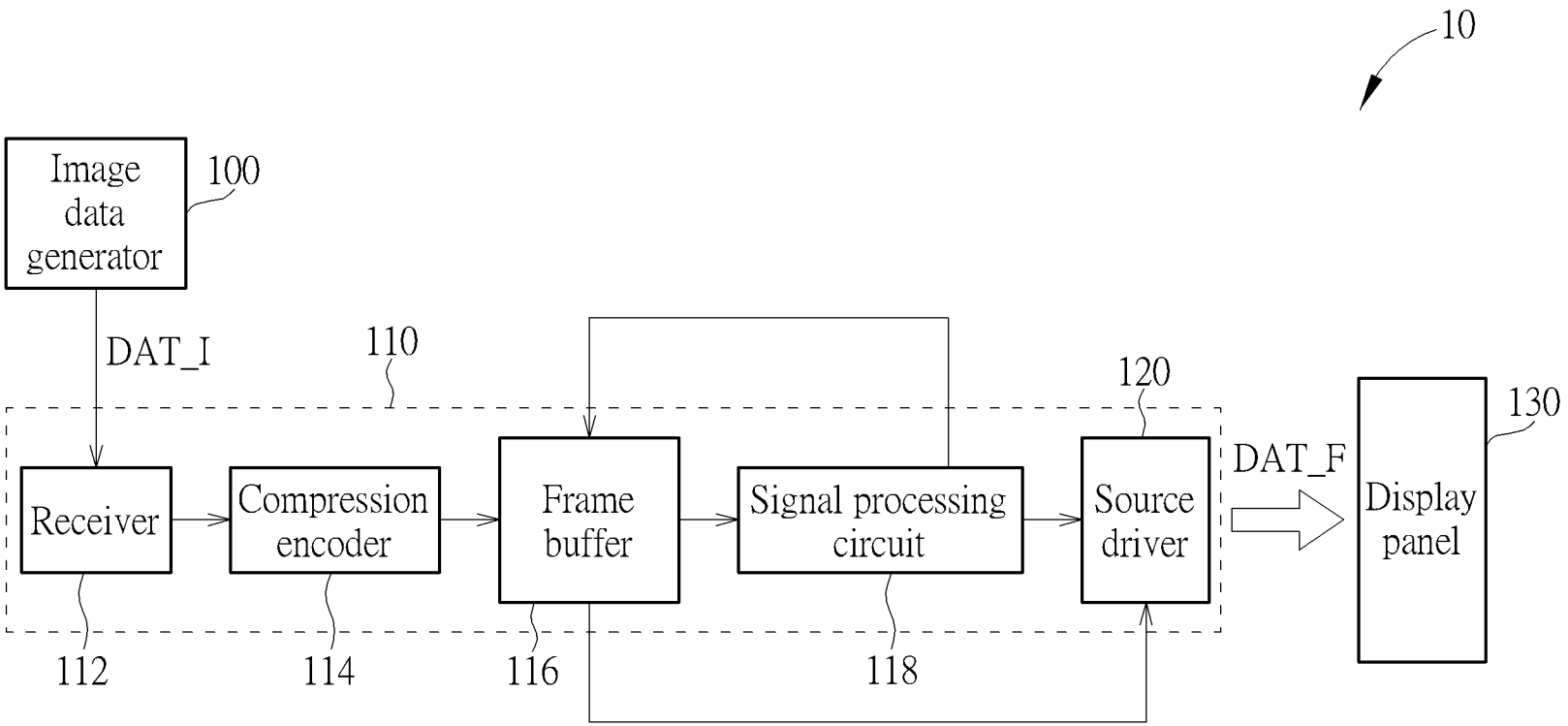
FIG. 1 is a schematic diagram of an image processing system according to an embodiment of the present invention.

Please refer to FIG. 1, which is a schematic diagram of an image processing system 10 according to an embodiment of the present invention. As shown in FIG. 1, the image processing system 10 includes an image data generator 100, an image processing device 110 and a display panel 130. The image data generator 100 may be an application program embedded in a controller or a processor, which is capable of generating image data DAT_I and outputting the image data DAT_I to the image processing device 110. The image processing device 110 is configured to process the image data DAT_I received from the image data generator 100 to generate final display data DAT_F, and output the final display data DAT_F to the display panel 130. The image processing device 110 may be included in a display driver integrated circuit (DDIC), which drives the display panel 130 to display based on the final display data DAT_F. The display panel 130 may be an organic light-emitting diode (OLED) panel, but is not limited herein.

In detail, the image processing device 110 includes a receiver 112, a compression encoder 114, a frame buffer 116, a signal processing circuit 118 and a source driver 120. The receiver 112 is configured to receive the image data DAT_I. The receiver 112 may have a transmission scheme conforming to the image data generator 100, so as to receive the image data DAT_I. In an exemplary embodiment, the receiver 112 is a mobile industry processor interface (MIPI) receiver.

The compression encoder 114 is configured to compress the image data DAT_I. In general, if the receiver 112 receives raw image data from the image data generator 100, the compression encode 114 may compress the raw image data so that the image data after compression has a smaller size and is able to be stored in the frame buffer 116. The compression ratio may be 1/3, 1/4 or any other possible ratio according to the size of the image data and the capacity of the frame buffer 116. In another embodiment, the image data generator 100 may follow the specification of Display Stream Compression (DSC) defined by Video Electronics Standards Association (VESA). In such a situation, the image data generator 100 transmits a compressed bitstream to the image processing device 110, and the bitstream may not need additional compression operation. In this embodiment, the bitstream may be transmitted to the frame buffer 116 without passing through the compression encoder 114. More specifically, if the image processing device 110 is configured to receive the bitstream of VESA DSC, the compression encoder 114 may be omitted. In addition, if the capacity of the frame buffer 116 is large enough to accommodate the image data DAT_I without compression, the compression encoder 114 may also be omitted.

The frame buffer 116 is configured to store the image data. Note that the frame buffer 116 may be realized with any type of memory device, such as a random access memory (RAM), flash memory and optical data storage device. In an embodiment, the final display data DAT_F after processing of the signal processing circuit 118 is restored in the frame buffer 116; hence, parts of the frame buffer 116 is configured to restore the final display data DAT_F.

Figure 2:
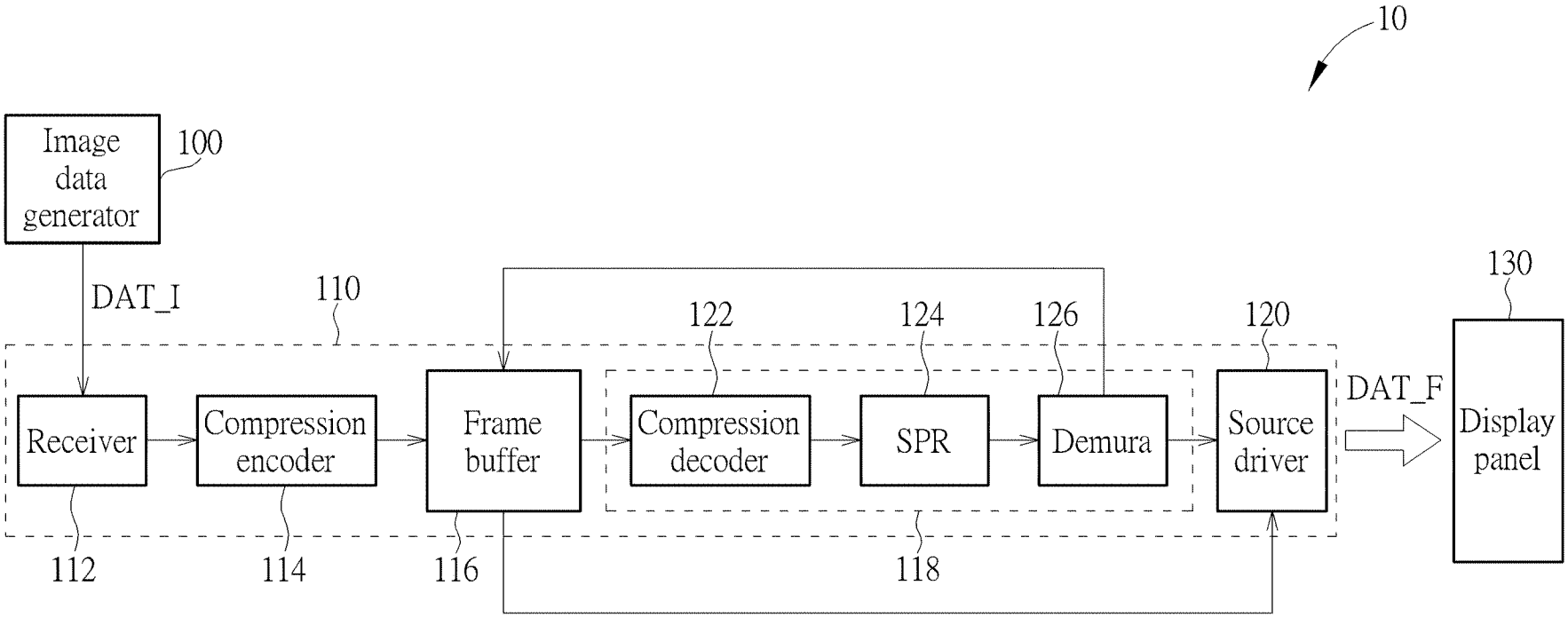
FIG. 2 is a schematic diagram of the image processing system with a detailed implementation of the signal processing circuit.

The signal processing circuit 118 is configured to perform a signal processing procedure on the image data DAT_I obtained from the frame buffer 116, to generate the final display data DAT_F. In an embodiment, the signal processing circuit 118 includes at least one of a compression decoder 122, a subpixel rendering (SPR) circuit 124 and a demura compensation circuit 126, as shown in FIG. 2. In other words, the signal processing circuit 118 may perform signal processing procedures including one or more of a decompression procedure, SPR operation, and demura compensation on the image data DAT_I obtained from the frame buffer 116. For example, if the receiver 112 receives raw image data from the image data generator 100 and the raw image data is compressed by the compression encoder 114 and then stored in the frame buffer 116, the compression decoder 122 may be a counterpart of the compression encoder 114 and is capable of decompressing the image data DAT_I. Alternatively, if the receiver 112 receives a bitstream of VESA DSC from the image data generator 100, the compression decoder 122 may be a decoder conforming to the specification of VESA DSC and is capable of recovering the image data before the DSC operation. The SPR circuit 124 is configured to perform SPR operation on the image data DAT_I. In the SPR operation, input image data for full-color pixels each having red, green, and blue subpixels is converted to output image data for pixels under the specific subpixel arrangement, for example each having two of the RGB subpixels, wherein another color component is rendered (or borrowed) from a neighbor pixel. The SPR operation aims at enhancing the visual resolution of the display image. In addition, the demura compensation circuit 126 is configured to perform demura compensation on the image data DAT_I. The demura technique retrieves the brightness and chroma of each pixel and thereby compensates the differences of the brightness and chroma between the pixels, allowing the display panel 130 to display in high uniformity.

The source driver 120 is configured to output the final display data DAT_F to the display panel 130. The source driver 120 may include circuit elements such as a digital-to-analog converter (DAC), a level shifter, a latch circuit and a shift register. Those skilled in the art may know the detailed implementations and operations of the source driver 120, which are therefore omitted herein.

As mentioned above, in the always on display (AOD) mode of the OLED panel, only simple information is shown on the panel, and thus power saving is an important issue to be considered. In the present invention, power consumption is reduced by turning off or disabling the power-consuming modules such as the compression decoder 122, the SPR circuit 124 and the demura compensation circuit 126 in the signal processing circuit 118. In detail, the image processing device 110 of the present invention has a normal mode and a power saving mode, and the image processing device 110 may enter the power saving mode when an AOD image needs to be displayed. When the image processing device 110 operates in the normal mode, the signal processing circuit 118 processes the image data DAT_I and outputs the final display data DAT_F to the source driver 120. When the image processing device 110 operates in the power saving mode, the circuits and modules in the signal processing circuit 118 are turned off.

Figure 3A:
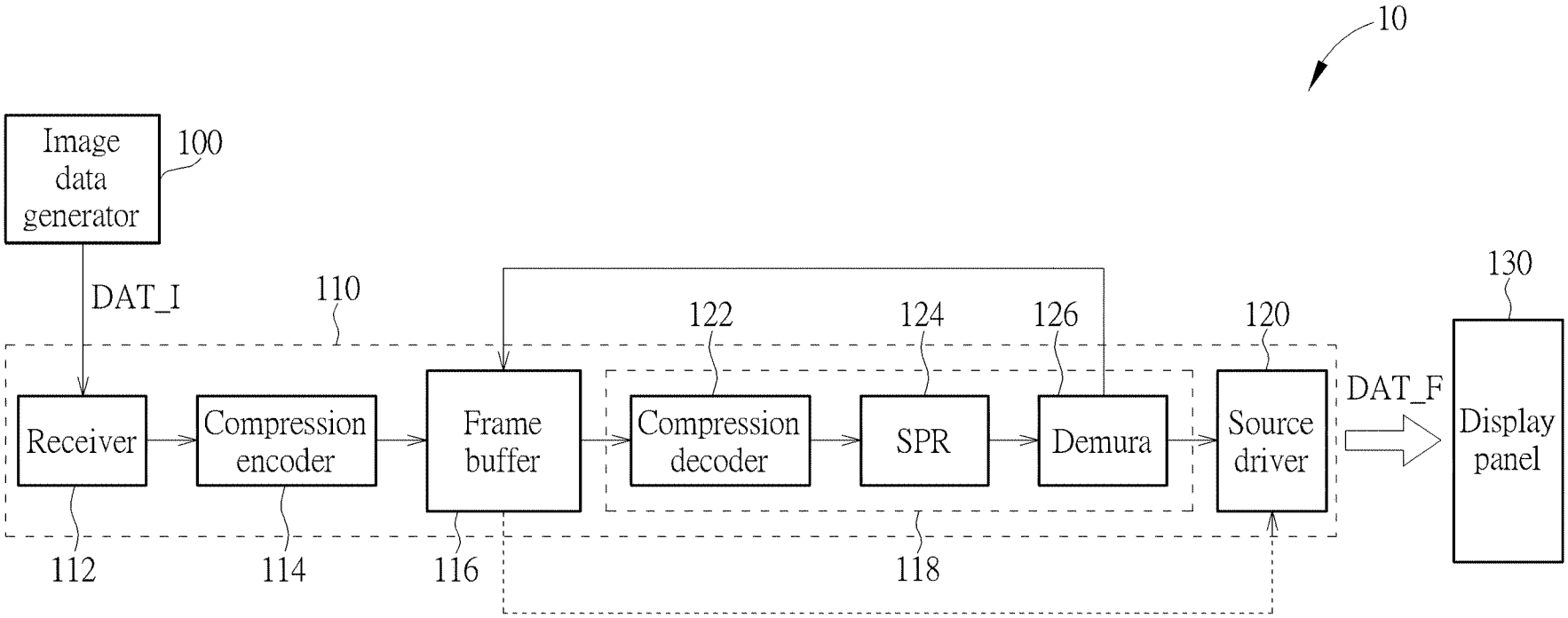
FIG. 3A is a schematic diagram illustrating the image processing system shown in FIG. 2 operates in the normal mode.

Please refer to FIG. 3A, which illustrates that the image processing system 10 shown in FIG. 2 operates in the normal mode. In the normal mode, the image data generator 100 keeps outputting the image data DAT_I to the image processing device 110 and the receiver 112 keeps receiving the image data DAT_I. The compression encoder 114 then compresses the image data DAT_I, so that the image data DAT_I is compressed to have a size adapted to the capacity of the frame buffer 116. The image data DAT_I is then stored in an area of the frame buffer 116 allocated to the image data DAT_I. Subsequently, the signal processing circuit 118 receives the image data DAT_I from the frame buffer 116 and processes the image data DAT_I, e.g., decompresses the image data DAT_I, performing SPR operation, and/or performing demura compensation, so as to generate the final display data DAT_F. The source driver 120 then outputs the final display data DAT_F received from the signal processing circuit 118, allowing the display panel 130 to display the final display data DAT_F.

Please note that, in the normal mode, the final display data DAT_F after the signal processing procedure of the signal processing circuit 118 is transmitted to the frame buffer 116, to be restored in the frame buffer 116. The final display data DAT_F restored in the frame buffer 116 may be used for image display in the power saving mode.

Figure 3B:
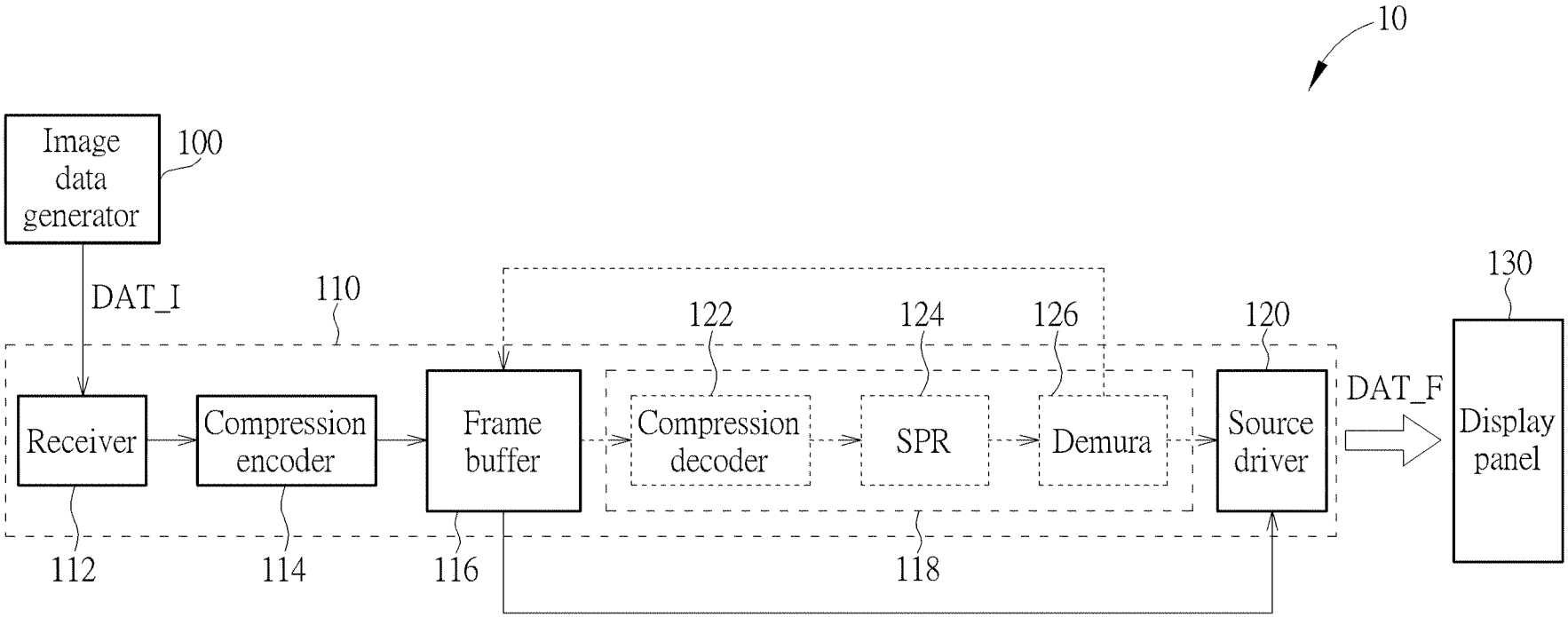
FIG. 3B is a schematic diagram illustrating the image processing system shown in FIG. 2 operates in the power saving mode.

Please refer to FIG. 3B, which illustrates that the image processing system 10 shown in FIG. 2 operates in the power saving mode. In the power saving mode, a still image including necessary information such as date, time, and/or power quantity keeps displayed on a dedicated area of the display panel 130. Therefore, the image data generator 100 stops outputting image data, and the receiver 112 stops receiving image data. In order to reduce power consumption, the circuits and modules in the signal processing circuit 118 that require much power are turned off. As shown in FIG. 3B, the compression decoder 122, the SPR circuit 124 and the demura compensation circuit 126 are turned off. At this moment, the source driver 120 receives the final display data DAT_F previously restored in the frame buffer 116 and outputs this final display data DAT_F, allowing the display panel 130 to display the final display data DAT_F.

In the power saving mode, the final display data DAT_F outputted to the display panel 130 is that previously processed by the signal processing circuit 118 in the normal mode and restored in the frame buffer 116. Therefore, the image quality in the power saving mode is not reduced with the reduction of power consumption since the final display data DAT_F outputted in the power saving mode undergoes the same signal processing procedure as in the normal mode. In the AOD display mode, most of the time the image content may not change, so the final display data DAT_F restored in the frame buffer 116 can be utilized for displaying the AOD image. When the display image changes or an image setting changes, other operations may be required.

Figure 4:
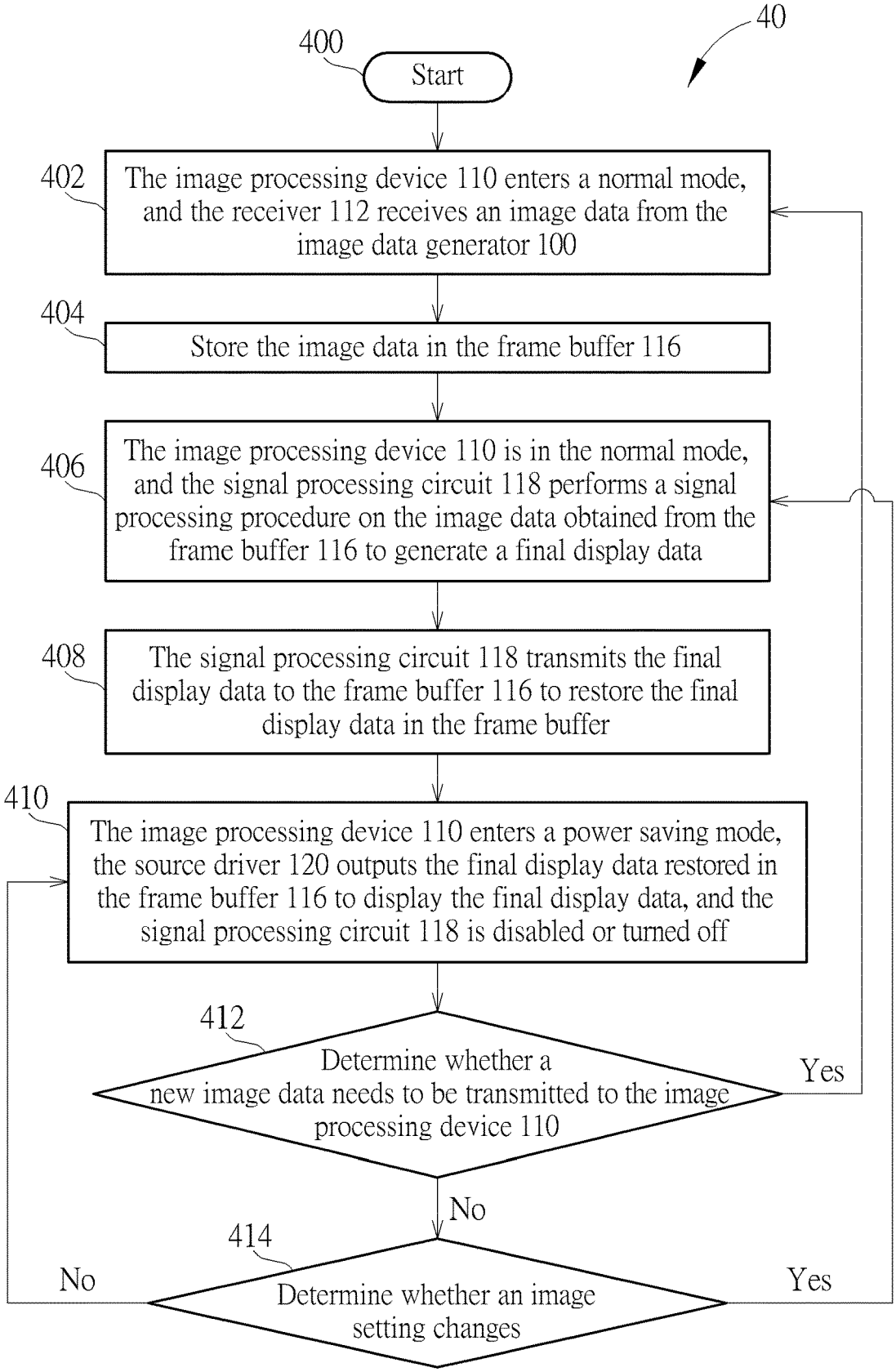
FIG. 4 is a schematic diagram of an image processing process according to an embodiment of the present invention.

Please refer to FIG. 4, which is a schematic diagram of an image processing process 40 according to an embodiment of the present invention. The image processing process 40 may be applied to an image processing device, such as the image processing device 110 shown in FIG. 1, for displaying an AOD image on a display panel. As shown in FIG. 4, the image processing process 40 includes the following steps:

Step 400: Start.

Step 402: The image processing device 110 enters a normal mode, and the receiver 112 receives an image data from the image data generator 100.

Step 404: Store the image data in the frame buffer 116.

Step 406: The image processing device 110 is in the normal mode, and the signal processing circuit 118 performs a signal processing procedure on the image data obtained from the frame buffer 116 to generate a final display data.

Step 408: The signal processing circuit 118 transmits the final display data to the frame buffer 116 to restore the final display data in the frame buffer.

Step 410: The image processing device 110 enters a power saving mode, the source driver 120 outputs the final display data restored in the frame buffer 116 to display the final display data, and the signal processing circuit 118 is disabled or turned off.

Step 412: Determine whether a new image data needs to be transmitted to the image processing device 110. If yes, go to Step 402; otherwise, go to Step 414.

Step 414: Determine whether an image setting changes. If yes, go to Step 406; otherwise, go to Step 410.

According to the image processing process 40, in the normal mode, the receiver 112 receives image data (e.g., DAT_I) from the image data generator 100. The image data DAT_I is compressed by the compression encoder 114 and then stored in the frame buffer 116 if the image data DAT_I is a raw image data. Alternatively, the image data DAT_I may be directly forwarded to the frame buffer 116 if the image data DAT_I is a bitstream of VESA DSC. The signal processing circuit 118 then performs the signal processing procedure on the image data DAT_I to generate a final display data (e.g., DAT_F). The final display data DAT_F is transmitted to the frame buffer 116 and restored in the frame buffer 116. Subsequently, the image processing device 110 enters the power saving mode, where all modules included in the signal processing circuit 118 are turned off to reduce power consumption. In the power saving mode (Step 410), the display panel 130 shows a still image, and the source driver 120 receives the final display data DAT_F restored in the frame buffer 116 and outputs this final display data DAT_F to the display panel 130. In such a situation, the signal processing circuit 118 may be turned off or disabled to save power.

Figure 5:
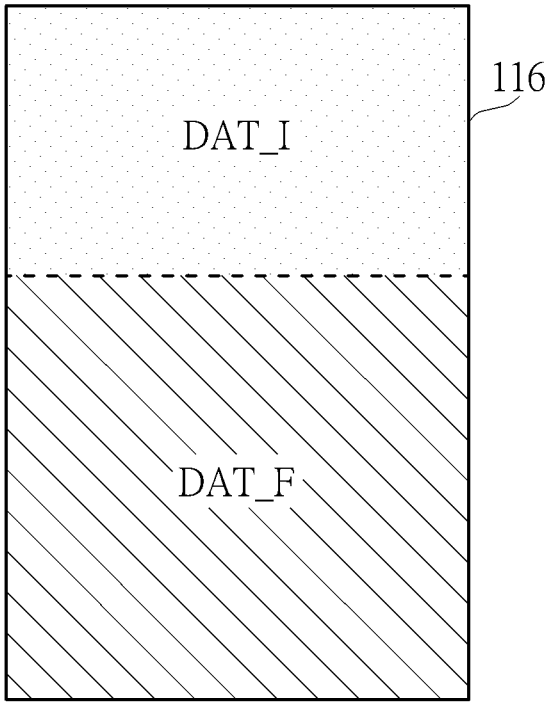
FIG. 5 is a schematic diagram of the frame buffer segmented to store the image data and the final display data.

In this embodiment, the frame buffer 116 is configured to store the image data DAT_I received from the image data generator 100 (after compression) and also store the final display data DAT_F after processing of the signal processing circuit 118. For example, the frame buffer 116 may be segmented into two parts, where a first part is allocated to the image data DAT_I and a second part is allocated to the final display data DAT_F, as shown in FIG. 5.

Please note that the final display data DAT_F restored in the frame buffer 116 undergoes the decompression operation of the compression decoder 122, such that the size of the final display data DAT_F in an image frame may be quite larger than the size of the image data DAT_I in an image frame, even if the size of the final display data DAT_F is slightly reduced due to the SPR operation. Fortunately, the AOD image only shows necessary information in a small area of the display panel 130; hence, it is not necessary to restore the final display data DAT_F of an entire image frame. More specifically, the final display data DAT_F restored in the frame buffer 116 may only include image data to be displayed in the AOD image, while the non-display area may not be restored.

It should also be noted that, due to a limited capacity of the frame buffer 116, a larger display area in an AOD image may not be accommodated in the area of the frame buffer 116 allocated to the final display data DAT_F. In such a situation, if the display area of an AOD image is larger than a threshold such that the corresponding final display data DAT_F cannot be accommodated by the area in the frame buffer 116 allocated to the final display data DAT_F, the image processing device 110 may be prohibited to enter the power saving mode. In other words, in order to display an AOD image occupying a larger area, a larger frame buffer may be disposed, or a larger area in the frame buffer may be allocated to the final display data DAT_F. In an embodiment, the image processing device 110 may receive an indication from the image data generator 100, where the indication indicates whether the image processing device 110 is prohibited to enter the power saving mode with a present AOD image. The indication may be carried in a flag or a register controlled by a processor or controller, or in a control signal received from a processor or controller.

In the power saving mode, the step of outputting the final display data DAT_F obtained from the frame buffer 116 is only applicable to a still image, where the image content does not change. In an idle mode displaying an AOD image, the display panel may be waked up by a user, and then a new image data should be displayed. In each image frame, the image processing device 110 may continuously determine whether the image content changes. For example, image processing device 110 may determine whether the image data generator 100 needs to transmit a new image data.

When no new image data is received, the image processing device 110 may remain in the power saving mode. The source driver 120 keeps outputting the final display data DAT_F obtained from the frame buffer 116. When a new image data arrives, the image processing device 110 may change to operate in the normal mode from the power saving mode. The new image data therefore undergoes the signal processing procedure to generate a new final display data and then the new final display data is transmitted to the display panel 130.

If the image processing device 110 determines that there is no new image data received, the image processing device 110 further determines whether an image setting related to the final display data DAT_F changes. For example, an OLED panel may move the object(s) in a still image after a period of time, in order to avoid image sticking. The moving operation means a change of display area in the AOD image, so that the image processing device 110 does not need to receive a new image data from the image data generator 100; instead, the image processing device 110 may receive an indication which indicates that the moving operation should be performed. Therefore, the signal processing circuit 118 may obtain the original image data DAT_I from the frame buffer 116. The image data DAT_I may be modified based on the updated image setting, and the modified image data is processed by the signal processing circuit 118 including decompression, SPR operation and/or demura compensation, to generate a new final display data. It should be noted that the modification of image setting (e.g., moving the object in an image) may change the pixel data of the image frame, such that the SPR and demura should be rearranged based on the new pixel data. Therefore, the previous processing result of the SPR and demura recorded in the previous final display data is not applicable to the new image data modified by the image setting change. In such a situation, the signal processing procedure such as the SPR operation and demura compensation may not be omitted for the new image setting. After the final image data corresponding to the new image setting is generated and restored in the frame buffer 116, the image processing device 110 may enter the power saving mode and the signal processing circuit 118 may be turned off.

Please note that the present invention aims at providing a method of processing image data and a related image processing device capable of achieving the purpose of power saving without reducing the quality of displayed image. Those skilled in the art may make modifications and alternations accordingly. For example, in the above embodiments, the image processing process 40 and related operations are applied to an AOD image. In another embodiment, the method of the present invention may be applicable to some applications other than the AOD image if the displayed image is a still image or parts of the displayed image do not change for a period of time. In addition, although the above embodiments are applied to an OLED panel, those skilled in the art may realize that the embodiments of the present invention are applicable to other type of display panel, such as a liquid crystal display (LCD). Further, the detailed structure of the signal processing circuit 118 is one of various implementations of the present invention. For example, the demura compensation circuit 126 may be arranged to be prior to the SPR circuit 124. Also, the signal processing circuit 118 may include other types of signal processing modules, and the types and numbers of signal processing modules included in the signal processing circuit 118 should not be a limitation of the present invention.

To sum up, the present invention provides a method of processing image data and a related image processing device. The image data received from a frame buffer may undergo a signal processing procedure having one or more signal processing operations such as data decompression, SPR operation and/or demura compensation. In the normal mode, the signal processing circuit performs the signal processing procedure on the image data. The source driver outputs the image data from the signal processing circuit to the panel, allowing the panel to display the image data. This image data is further transmitted to the frame buffer and restored in the frame buffer. In the power saving mode, the source driver outputs the image data restored in the frame buffer, for displaying a still image such as an AOD image. At this moment, the modules in the signal processing circuit may be turned off to save power consumption. When a new data arrives or an image setting changes, the image processing device enters the normal mode and wakes up the signal processing circuit. As a result, the final display data outputted in the power saving mode undergoes the same signal processing procedure as in the normal mode; hence, power saving may be achieved without reducing the image quality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of processing an image data for an image processing device, the method comprising:

receiving the image data;

storing the image data in a frame buffer of the image processing device;

performing a signal processing procedure on the image data obtained from the frame buffer, to generate a final display data;

restoring the final display data in the frame buffer; and entering a power saving mode after the final display data is restored in the frame buffer, and performing the following steps in the power saving mode:

turning off the signal processing circuit; and outputting the final display data restored in the frame buffer, to display the final display data.

2. The method of claim 1, further comprising:

outputting the final display data received from a signal processing circuit performing the signal processing procedure, to display the final display data in a normal mode.

3. The method of claim 2, wherein the image processing device is operating in the power saving mode, and the method further comprises:

changing to operate in the normal mode when a new image data is received or an image setting changes; and remaining in the power saving mode when no new image data is received and no image setting changes.

4. The method of claim 1, wherein the signal processing procedure comprises at least one of a decompression procedure, a subpixel rendering, and a demura compensation.

5. An image processing device, comprising:

a receiver, configured to receive an image data;

a frame buffer, configured to store the image data;

a signal processing circuit, configured to perform a signal processing procedure on the image data obtained from the frame buffer to generate a final display data, and transmit the final display data to the frame buffer to restore the final display data in the frame buffer; and a source driver, configured to output the final display data restored in the frame buffer, to display the final display data in a power saving mode;

wherein the signal processing circuit is turned off in the power saving mode.

6. The image processing device of claim 5, wherein the source driver is further configured to output the final display data received from the signal processing circuit to display the final display data in a normal mode.

7. The image processing device of claim 6, wherein the image processing device is operating in the power saving mode, and the image processing device changes to operate in the normal mode when a new image data is received or an image setting changes, or remains in the power saving mode when no new image data is received and no image setting changes.

8. The image processing device of claim 5, wherein the signal processing circuit comprises at least one of a compression decoder, a subpixel rendering circuit, and a demura compensation circuit.

* * * * *